United States Patent [19]

Boselli

[11] Patent Number: 4,796,316

[45] Date of Patent: Jan. 10, 1989

[54] MATTRESS WITH AERATION CAVITIES

[75] Inventor: Alain Boselli, Triel Sur Seine, France

[73] Assignee: Dunlop France, Hauts-de-Seine, France

[21] Appl. No.: 119,507

[22] Filed: Nov. 12, 1987

[30] Foreign Application Priority Data

Nov. 13, 1987 [FR] France ..... 86 15732

[51] Int. Cl.[4] ..... A47C 27/00

[52] U.S. Cl. ..... 5/464; 5/468; 5/481

[58] Field of Search ..... 5/446, 447, 461, 464, 5/468, 469, 481; 297/DIG. 1

[56] References Cited

U.S. PATENT DOCUMENTS 2,192,601 3/1940 Mattison .
2,788,061 4/1957 Pedrocchi ..... 5/481 X
3,210,781 10/1965 Pollock ..... 5/481 X
3,885,257 5/1975 Rogers ..... 5/481 X
4,070,719 1/1978 Morgan .

FOREIGN PATENT DOCUMENTS 2930750 2/1981 Fed. Rep. of Germany ..... 5/468
86301 4/1961 United Kingdom .
1559851 1/1980 United Kingdom ..... 5/464

*Primary Examiner*—Alexander Grosz
*Assistant Examiner*—Michael F. Trettel
*Attorney, Agent, or Firm*—Armstrong, Nikaido, Marmelstein & Kubovcik

[57] ABSTRACT

The invention provides a mattress with aeration cavities, consisting of a layer of flexible material with a lower face (3) by which the mattress may bear on an undermattress and an upper face (4) for receiving the body of a person, each face being defined by an edge (5), the lower face (3) having a plurality of cavities (10, 110).

9 Claims, 4 Drawing Sheets

MATTRESS WITH AERATION CAVITIES

BACKGROUND OF THE INVENTION

The invention relates to a mattress comprising of a layer made from a flexible material generally covered with a protecting bag which has a lower face by which the mattress may bear on an undermattress and an upper face for receiving the body of a person, each face being defined by an edge. It may for example be a mattress equipping a bed or settee but also a cushion of smaller size equipping an armchair or a pillow.

Because of its resilience, the mattress may also be deformed under the weight of a body to take on the shapes thereof, but may also resume its initial form once the pressure is removed.

It has been observed that during use the resilient properties of the mattress decreased and that it therefore had a tendency to keep its deformation. The result is that the mattress is then no longer able to correctly adapt itself to the shapes of the body and so to support it efficiently. Furthermore, such a permanent deformation is unaesthetic.

The applicant has discovered that the aging of a mattress that is to say the degradation of its resilient characteristics, results not only from repeated cycles of compression and expansion that it undergoes, but also from the presence of humidity in its mass.

He has also discovered that the lower part of the mattress had the highest rate of humidity.

The aim of the invention is then to provide a mattress of the above mentioned type having means for reducing its aging by humidity.

SUMMARY OF THE INVENTION

In accordance with the invention the lower face of the mattress has a plurality of cavities.

Thus, the contact surface between the mattress and the undermattress is reduced, the non contacting zones benefitting then from the presence of the surrounding air.

In addition, each cavity plays the role of a bellows filled with air which, when the mattress is compressed by the weight of a body, is itself compressed and expels this air. The air within each cavity is thus renewed. The turbulence created also promotes the flow of air in the vicinity of the cavity, that is to say at the interface between the mattress and the undermattress.

The applicant noted that such a mattress has satisfactory resistance to aging by humidity.

Preferably, the cavities include a plurality of substantially parallel grooves spaced apart from each other and each having two ends by which they emerge on the edge of the lower face.

In the case where the mattress has a rectangular shape, the grooves extend advantageously transversally.

In a preferred embodiment of the invention, the mattress has, in its length, a central region edged by two end regions, a plurality of pockets being disposed with spacing along each groove in both end regions, each pocket extending from the bottom of the groove towards the upper face of the mattress so as to locally increase the depth of the groove.

When the mattress is intended to equip an undermattress having a plurality of slats spaced apart from each other the dimensions and arrangements of the grooves and the pockets are advantageously chosen so that, when the mattress rests on the undermattress, they each have a zone opening freely to the surrounding air.

Preferably, the depth of the grooves is substantially constant whereas that of the pockets is all the greater the further these pockets are removed from the longitudinal and transverse median axes of the mattress.

When the mattress is intended to receive two persons side by side, it advantageously has a median zone extending over the whole length of the mattress and in which the depth of the grooves is reduced.

As a complement, the upper face of the mattress has a plurality of grooves whose depth is substantially constant and less than that of the grooves of the lower face.

BRIEF DESCRIPTION OF THE DRAWINGS

Other details and advantages of the invention will become clear from the following description of a preferred non limitative embodiment, with reference to the accompanying drawings in which.

DESCRIPTION OF THE PREFERRED EMBODIMENT

Figure 1:
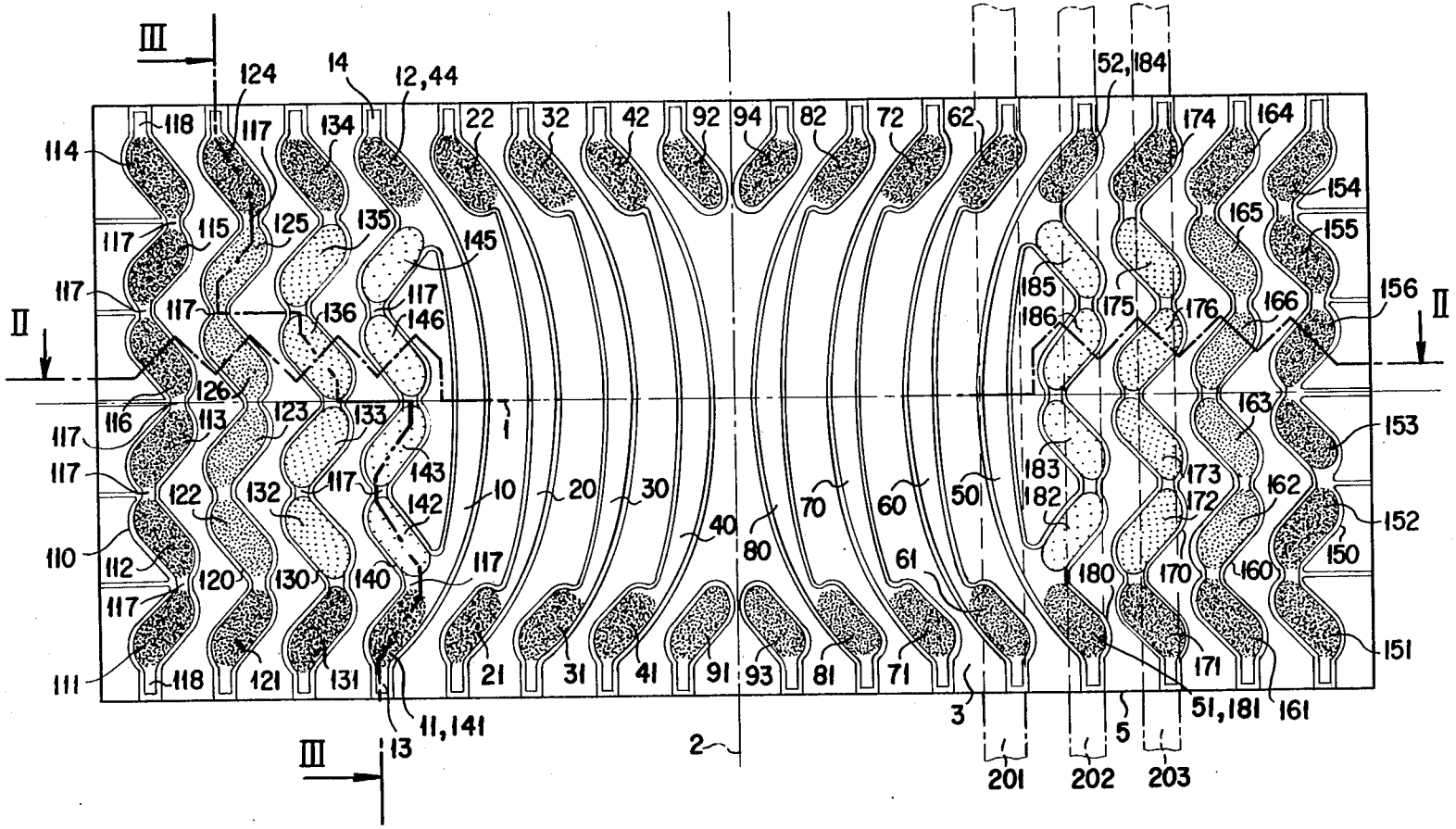
FIG. 1 is a bottom view of the mattress of the invention.

In FIGS. 1 to 5 a mattress has been shown made from polyurethane foam molded in a single piece, which has the shape of a rectangular plate with longitudinal axis 1 and transverse axis 2, with a lower face 3 intended to bear on the undermattress of a bed and an upper face 4 intended to support the body of a person lying down, these faces being respectively defined by an edge 5, 6.

The lower face 3 has sixteen substantially transverse grooves spaced apart substantially evenly from each other, which all open in the edge 5 of this face.

Observed in its length, the mattress has a central region bordered by two end regions. The central region includes 8 identical grooves 10 to 80 in the form of an arc, spaced apart symmetrically with respect to the transverse axis 2, each groove having its convexity turned towards the transverse axis.

The width of each arc shaped groove decreases slightly from the longitudinal axis 1 towards the edge 5 of the mattress. However, a pocket (11, 12), (21, 22) . . . (81, 82) of an oval shape is disposed in line with the corresponding groove 10, 20, . . . 80, at each of the ends of the groove and at a short distance from the edge 5 of the mattress. This pocket locally doubles the width of the groove. There are then in all sixteen pockets in line with the different arc shaped grooves.

Seen in section, each arc shaped groove 10 to 80 and each pocket (11, 12) to (81, 82) has the shape of a V with a rounded bottom.

Figure 3:
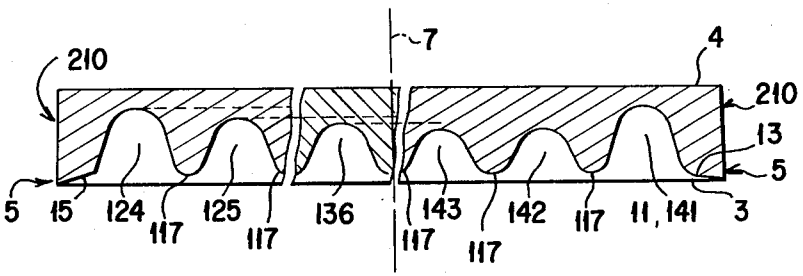
FIG. 3 is a cross sectional view through the broken line III—III of FIG. 1.

The depth of the arc shaped groove 10 is constant over the whole of its length, except for the ends where it is substantially greater (that is to say more than three times greater) in line with the pocket (11, 12) to (81, 82), as can be seen in FIG. 3 where pocket 11 is visible. Then, between the pocket 11 and edge 5 of the lower face 3 of the mattress, groove 10 has in section a ramp shape 13, 14 by which its depth decreases progressively to zero in the direction of edge 5. In the absence of such ramps 13, 14, once covered with a protecting bag, the mattress would have two unaesthetic hollows close to the edge 5 of the mattress. It is also clear from FIG. 3 that all the arc shaped grooves such as 10, 20, 30, 40, have the same depth with respect to each other, since these grooves are identical.

Between the two arc shaped grooves 40, 80 adjacent the transverse axis 2 and in the vicinity of edge 5, two pairs of pockets (91, 93) and (92, 94) are disposed symmetrically with respect to the longitudinal axis 1, the pockets of each pair being themselves symmetrical with respect to the transverse axis. Each of these pockets is connected to edge 5 by a ramp shaped groove identical to ramp 13 shown in FIGS. 1 and 3.

As is clear from FIG. 1, the two end regions of the mattress each have four grooves 110, 120, 130, 140 and 150, 160, 170, 180. Each groove zig zags through the mattress in six segments. In line with each segment is disposed a pocket. For example, the zig zag groove 110 has six pockets 111 to 116, the zig zag groove 160 has six pockets 161 to 166. There is therefore in all forty eight pockets in line with the different zig zag grooves. These pockets are, seen solely from above, identical in shape and in size to the pockets relative to the arc shaped grooves.

Pockets 111 to 160 of the same zig zag groove 110 are connected together in pairs by a groove portion 117 whose width is equal to about half that of the pockets. Finally, the two pockets 111, 114 adjacent edge 5 of the mattress are joined thereto by a ramp shaped groove portion 118 identical to ramp 13 shown in FIGS. 1 and 3.

All the zig zag grooves, seen solely from above, are identical with each other, those 110, 120, 130, 140 of a first end region being symmetrical with those 150, 160, 170, 180 of the second end region, with respect to the transverse axis 2 of the mattress. However, the two zig zag grooves 140, 180 respectively adjacent the arc shaped grooves 10, 50 have two pockets in common with these latter. Thus the two pockets 144 and 141 of the zig zag groove 140 form the two pockets 12, 11 of the arc shaped groove 10.

It is clear from FIG. 1 that the arrangement and shape of the grooves have been chosen so that no appreciable portion of the lower face 3 of the mattress is without grooves, but on the contrary the spacing between the different grooves is even.

Seen in section, each zig zag groove is arranged as shown in the right hand part of FIG. 3, where half of the zig zag groove 140 has been shown and extends from the edge 5 of the mattress as far as the median longitudinal plane 7 of the mattress.

The ramp 13 can first of all be recognized, then pockets 141, 142 and 143 separated from each other by groove portions 117. The depth of the zig zag groove, at the level of the groove portions 117, is equal to half that of the arc shaped grooves 10 to 80. The depth of pocket 141 adjacent edge 5 of the mattress is equal to seven times the depth of the groove portions 117, whereas the depth of the two pockets 142 and 143 is equal to only five times the depth of the groove portions 117.

The other half of the zig zag groove 140 is symmetrical with that described above with respect to the longitudinal median plane 7 of the mattress.

In the left hand part of FIG. 3, and from the edge 5 of the mattress, there extend a ramp 15, then pockets 124 and 125 of the zig zag groove 120 and finally, in another sectional plane, the pocket 136 of the zig zag groove 130. The groove portions 117 all have the same depth whatever the zig zag groove considered. Pocket 124 adjacent edge 5 has a depth equal to that of pocket 141, that is equal to seven times the depth of the groove portions 117. Pocket 125 has a depth equal to six times that of the groove portions 117 and pocket 136 has a depth between five and six times that of the groove portions 117. Dotted lines show the differences of depth of the pockets.

Several conclusions may be made from observing FIG. 3. First of all, in the right hand part of the Fig., the pocket such as 141, the furthest away from the longitudinal axis 1 of the mattress and situated in the vicinity of edge 5 of the mattress, have a depth greater than that of the other pockets such as 142, 143 situated closer to the longitudinal axis 1. It will however be noted that the depth of pockets 142 and 143 is the same, although they are at a different distance from the longitudinal axis 1

Then, the pockets such as 143, 136 and 125 which are not the furthest away from the longitudinal axis 1 have however increasing depth to the extent that they are situated at increasing distances from the transverse axis 2 of the mattress.

This rule does not hold for the pockets such as 124 and 141 the furthest away from the longitudinal axis 1, which have the same depth although their distance to the transverse axis 2 is not the same. In fact, all the peripheral pockets such as 116, 115, 114, 124, 134, 144, 22, 32, 42 and 92 have the same depth, namely the greatest depth.

The differences in depth of the pockets have been shown in FIG. 1 by blackening the pockets, all the darker the deeper they are.

Figure 2:
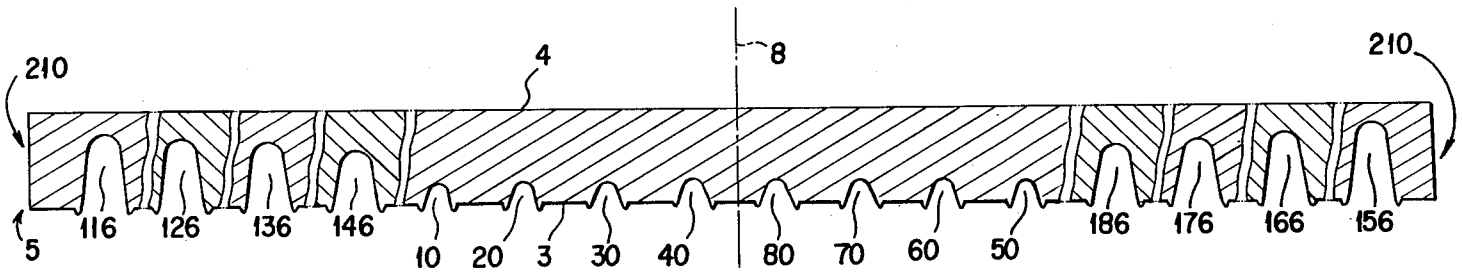
FIG. 2 is a view in longitudinal section through the broken line II—II of FIG. 1.

FIG. 2 illustrates the evolution of the depth of the pockets of the different zig zag grooves along the longitudinal axis 1 of the mattress. This Fig. is symmetrical with respect to the median transverse plane 8 of the mattress. In the left hand part of FIG. 2, pockets 146, 136, 126 and 116 succeed each other in different sectional planes; they belong respectively to the zig zag grooves 140, 130, 120 and 110.

As mentioned above in connection with FIG. 3, since these pockets are situated at increasing distances from the transverse axes 2—here the transverse plane 8 and since it is not a question of peripheral pockets, except for pocket 116, their depth is increasing. The depths of pockets 146, 136, 126 and 116 are respectively equal to a little less than five times, a little more than five times, six times and seven times the depth of the groove portions 117. Insofar as the dimensions of the cavities provided on the lower face of the mattress are concerned, the width of the different grooves varies preferably between 10 and 60 mm, in the present case between 20 and 40 mm, the mattress having a width of 900 mm. The pockets have a length preferably between 80 and 160 mm, in the present case a length of 120 mm, and a width preferably between 30 and 90 mm, in the present case a width of 60 mm.

The depth of the grooves is preferably between 5 and 40 mm for a mattress thickness equal to 130 mm; in the present case this depth varies between 15 and 30 mm.

The depth of the pockets will be preferably between 50 and 110 mm; in the present case it varies between 70 and 100 mm.

More generally, the dimensions of the cavities will be chosen as a function of those of the mattress and of the weight it is intended to support. In the example described above, the dimensions and shape of the cavities vary over the extent of the mattress so as to take into account the forces which will be applied locally, and which themselves vary over the extent of the mattress. In fact, when a person is lying on the mattress, the mattress is heavily stressed in its middle region supporting the weight of the trunk and buttocks, whereas the mattress is appreciably less stressed in its end regions which only support the weight of the head or legs.

The depth of the cavities is a determining parameter since it determines correspondingly the thickness of the mattress in line with these cavities. Now, a zone of the mattress will be all the more able to support a weight the greater its thickness and will thus allow high compression of the mattress. In FIGS. 2 and 3, the variations in depth of the cavities—that is to say the variations in thickness of the mattress—are related to the distribution of the weight of the body over the mattress.

This is why the central region only has cavities—in the present case grooves—whose depth is small with respect to the thickness of the mattress, whereas at the periphery of the mattress the proportions are reversed.

The dimensions and shapes of the cavities also take into account the requirements for molding the mattress. Thus, the depth of the groove portions 117 (FIG. 3) has been chosen small so as to promote flowing of the material during molding. In fact, the mold will have several bosses corresponding to the different pockets, which by their height will oppose distribution of the material, but it will also have several ribs of small height corresponding to the different groove portions, which only opposes distribution of the material very little. To sum up, a deep cavity in the mattress may not extend continuously over its length. On the other hand, the arc shaped grooves 10 to 80 (FIGS. 1 and 2) may extend continuously, since they have a small depth.

Although such precautions are taken, any material will not be suitable for molding the mattress. A material will be preferably chosen subject to natural expansion in volume. Thus, at the beginning of molding polyurethane only fills the bottom of the mold. During molding, and particularly following heating of the product, the polyurethane expands considerably until it fills the whole inner volume of the mold, thus promoting its distribution despite the presence of the bosses and grooves in the mold.

More generally, expandable plastic foams are the preferred materials.

The dimensions and shapes of the cavities further comply with other requiremens. First of all, the cavities must not be closed by the undermattress. The undermattresses which may be used are those having a lattice work, a stretched cloth or else rigid slats disposed in parallel and spaced from each other, or other undermattresses not having a continuous and impermeable surface which would close the cavities.

The mattress shown in the Figs. has been designed in particular for an undermattress with slats. In FIG. 1, three slats 201 and 203 have been shown. The arc shaped grooves such as 50 and the zig zag ones such as 180 each extend, in the direction of the longitudinal axis 1 of the mattress, over a distance determined as a function of the standard dimensions of commercial slats, in a known range of sizes, and as a function of the spacing of these slats.

In FIG. 1, the arc shaped groove 50 has several zones opening freely to the surrounding air. Similarly, each pocket of the zig zag groove 180 has at least one zone opening freely to the surrounding air.

Furthermore, the different orientation of two adjacent pockets 181, 182 in the same zig zag groove 180 reinforces the rigidity of the mattress, more precisely by preventing collapse of the side wall 210 of the mattress (FIGS. 2 and 3). The symmetry of the whole of the mattress with respect to its longitudinal 1 and transverse 2 axes similarly contributes to reinforcing the rigidity of the mattress.

Figure 4:
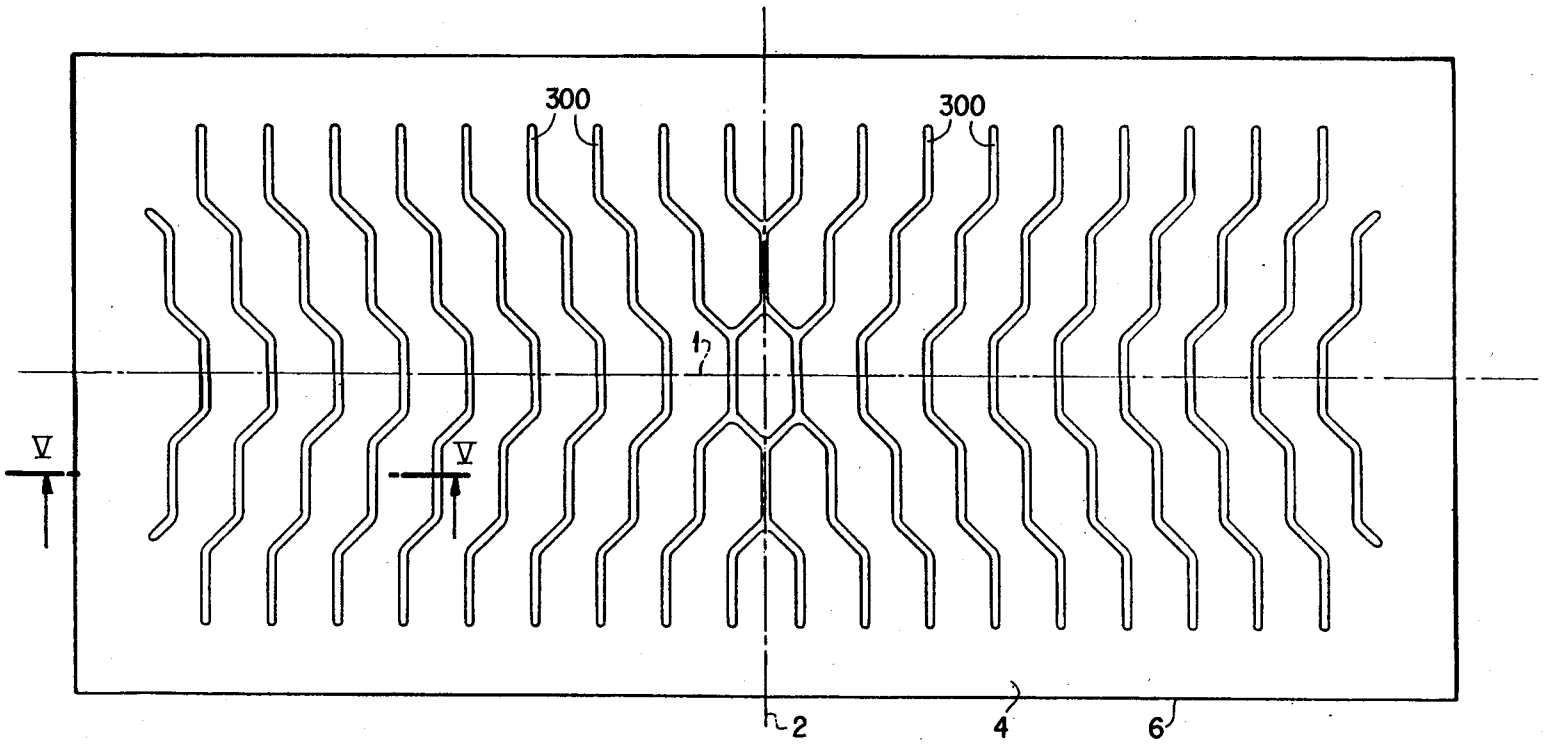
FIG. 4 is a top view of the mattress of the invention.
Figure 5:
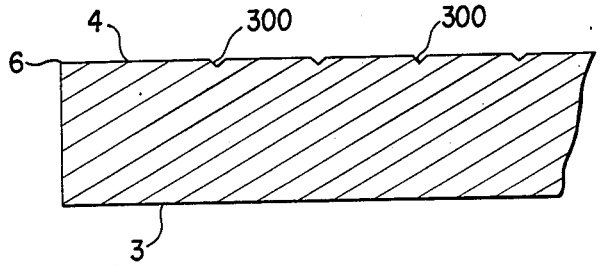
FIG. 5 is a partial sectional view through line V—V of FIG. 4.

As shown in FIGS. 4 and 5, the upper face 4 of the mattress also has cavities. These are parallel grooves 300 which extend with spacing across the mattress. Each groove 300 has a uniform width and depth; it ends at a certain distance from the edge 6 of the upper face 4. Each groove 300 has the shape of a V in section.

The presence of such grooves must naturally not be felt by the user. Thus, the width and depth of the grooves are very small. The width is preferably between 8 and 16 mm and in the present case equal to 12 mm. The depth is preferably between 3 and 9 mm and in the present case equal to 6 mm.

It will be noted that, for simplifying the drawings, the grooves on the upper face 4 of the mattress and those on the lower face 3 have not been shown simultaneously in the same FIG.

Figure 7:
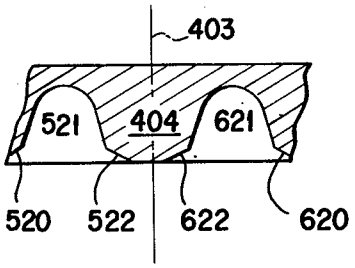
FIG. 7 is a partial sectional view through line VII—VII of FIG. 6.
Figure 6:
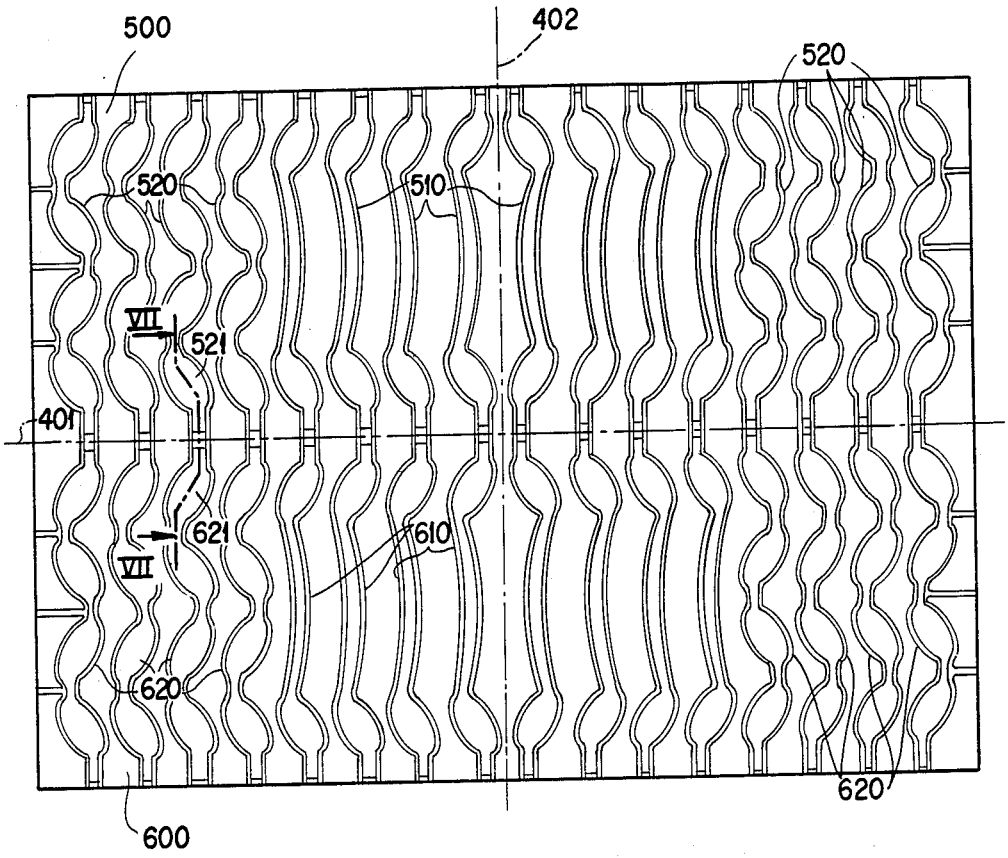
FIG. 6 is a bottom view of a mattress for two persons.

The double mattress, the lower face of which has been shown in FIG. 6 and 7, is intended to receive two persons. It has a longitudinal axis 401 and a transverse axis 402. On each side of the longitudinal axis 401 are provided two identical patterns of cavities 500, 600, similar to the pattern of FIG. 1.

Each pattern has then respectively eight arc shaped grooves 510, 610 in a central region and four zig zag grooves 520, 620 in two end regions.

The connection between the two patterns 500 and 600 is illustrated in FIG. 7. Pocket 521 of the zig zag groove 520 is joined to the median longitudinal plane 422 of the mattress by a ramp 522. Similarly, pocket 621 of the zig zag groove 620 is joined to this plane by a ramp 622. There exists then a median zone 404 of the mattress which extends over the whole length thereof, and in which the depth of the grooves is zero or substantially zero. This compact median zone 404 provides isolation between the two portions 500, 600 of the double mattress, in that the movements of a person on portion 500 will be little felt by the person on portion 600. The median zone 404 also contributes to opposing collapse of the side wall of the double mattress.

The upper surface of the double mattress has two patterns similar to that of FIG. 4.

Remarkably, the cavities of the mattress of the invention do not weaken this latter but on the contrary reinforce it. In fact, the outer surface of the mattress is increased by each of the cavities. Now, this outer surface has a "skin" from molding whose rigidity is greater than the material forming the core of the mattress.

It will be noted that the efficiency of the cavities in combatting humidity is all the greater the larger their volume.

Furthermore, the fact that the pockets of the same zigzag groove are connected together through groove portions 117, as can best be seen in FIG. 3, promotes stirring of the air contained in the different pockets: the portions of the groove 117 thus contribute appreciably to the removal of humidity. Similarly, the ramps 13, 15 which join the pockets 124, 141 with the outside, promote the expulsion of the air contained in the groove when the mattress is compressed.

It should be noted that the mattress shown in the Figs. provides an advantageous compromise. In so far as the mechanical behavior of the foam is concerned, and disregarding the presence of humidity, it is when the foam is the most solid that is has the best efficiency and even that its mechanical characteristics are better maintained in time.

On the other hand, considering now solely the problem concerning the presence of humidity, the mechanical characteristics of the foam will be all the less affected in time by humidity the more cavities of large size the foam has.

The progressivity of the depth of the cavities of the mattress of the invention, such as shown in FIG. 2, well illustrates the compromise obtained.

Very advantageously, and as a complement to the cavities, the material forming the mattress may have a density and a hardness—or lift—which vary along the mattress.

More precisely, the central region without pockets—or core of the mattress—will have a higher density than the peripheral regions with pockets, so that it is even more solid.

In addition, this central region will have a lower hardness than the peripheral regions: it is in fact desirable for the feeling of flexibility of the mattress to be felt especially in the central region for it to accomodate a body.

In the present case, a density of 48 $kg/m^3$ and a hardness in accordance with the standard NF.T. 56110 of 35 $g/cm^2$ have been chosen for the central region, whereas the density of 40 $kg/m^3$ and a hardness of 40 $g/cm^2$ were chosen for the peripheral regions.

More generally, the density may vary between 35 and 70 $kg/m^3$, and the hardness between 20 and 80 $g/cm^2$.

The whole of the characteristics of the present invention apply particularly well to mattresses equipping a bed, and having the standard bedding dimensions (width between 0.7 m and 1.6 m and length between 1.9 m and 2 m).

I claim:

1. A mattress comprising a layer of a flexible material with a lower face (3) by which the mattress may bear on an undermattress, and an upper face (4) intended to receive the body of a person, each face being defined by an edge (5, 6), the lower face (3) having a plurality of pockets (111 to 116) disposed at the periphery of the mattress and extending into a major part of the thickness of the mattress, wherein said mattress is an expandable plastic foam, the lower face (3) having several grooves (110, 120) extending into a small part of the thickness of the mattress, said pockets being disposed in line with said grooves so as to locally increase the depth of the grooves.

2. The mattress as claimed in claim 1, wherein each groove (110) has two ends (13, 14) by which it opens at the edge (5) of the lower face (3) of the mattress.

3. The mattress as claimed in claim 1 or claim 2, which has a rectangular shape, the grooves (10, 110) extending transversely of a longitudinal median axis of the mattress.

4. The mattress as claimed in claim 1, wherein said mattress has a longitudinal median axis and a transverse median axis, and the depth of the grooves (10, 110) is substantially constant whereas that of the pockets (116, 126, 136, 146) is all the greater the further these pockets are removed from the longitudinal and transverse median axis of the mattress.

5. The mattress as claimed in claim 1, for receiving two persons side by side, characterized in that it has a median zone (404) in which the depth of the grooves is reduced in comparison with the depth of the grooves in the remainder of the mattress.

6. The mattress as claimed in claim 1, wherein said upper face (4) has a plurality of grooves (300) whose depth is substantially less than that of the grooves of the lower face.

7. The mattress as claimed in claim 1, wherein the mattress has a central region and peripheral regions therearound, and the material forming the mattress has a higher density but a lower hardness in the central region of the mattress than in its peripheral regions.

8. The mattress as claimed in claim 1, wherein said mattress has a longitudinal median axis and said grooves extend transverse of said axis in non-linear fashion.

9. The mattress as claimed in claim 8, wherein said mattress has a central region and peripheral regions therearound, the grooves (110, 120) of the peripheral regions extend in a zig zag fashion and those (10, 20) of the central region extend along an arc.

* * * * *

UNITED STATES PATENT AND TRADEMARK OFFICE

CERTIFICATE OF CORRECTION

PATENT NO. : 4,796,316

DATED : January 10, 1989

INVENTOR(S) : Alain BOSELLI

It is certified that error appears in the above-identified patent and that said Letters Patent is hereby corrected as shown below:

On the cover page, Item [30] "November 13, 1987" should read --November 13, 1986--.

Signed and Sealed this

Third Day of October, 1989

*Attest:*

DONALD J. QUIGG

*Attesting Officer*

*Commissioner of Patents and Trademarks*